US006560927B2

(12) United States Patent
Schulte

(10) Patent No.: US 6,560,927 B2
(45) Date of Patent: May 13, 2003

(54) COUNTERACTION SYSTEM FOR A SECTIONAL DOOR

(75) Inventor: Peter S. Schulte, East Dubuque, IL (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

(21) Appl. No.: 09/870,019

(22) Filed: May 30, 2001

(65) Prior Publication Data

US 2002/0178653 A1 Dec. 5, 2002

(51) Int. Cl.[7] ..... E05F 11/54
(52) U.S. Cl. ..... 49/200; 16/194; 160/190
(58) Field of Search ..... 49/199, 200, 447, 49/197; 160/190, 201; 16/194, 216, 400, DIG. 1

(56) References Cited

U.S. PATENT DOCUMENTS

| | | | | |
|---|---|---|---|---|
| 565,612 A | * | 8/1896 | Fernald | |
| 980,126 A | * | 12/1910 | Prescott | |
| 1,600,372 A | * | 9/1926 | Streeter | |
| 1,677,578 A | * | 7/1928 | Barr | |
| 1,808,413 A | * | 6/1931 | Hurlet et al. | |
| 2,523,929 A | * | 9/1950 | Taylor | |
| 3,981,343 A | * | 9/1976 | DeVito | 160/9 |
| 4,800,946 A | | 1/1989 | Rosenoy | 160/264 |
| 4,887,659 A | | 12/1989 | West | 160/199 |
| 5,129,442 A | | 7/1992 | Warner | 160/271 |
| 5,259,433 A | * | 11/1993 | Cloutier | 160/190 |
| 5,271,183 A | | 12/1993 | Hahn et al. | 49/360 |
| 5,353,859 A | | 10/1994 | Oltahfer et al. | 160/310 |
| 5,392,836 A | | 2/1995 | West et al. | 160/273.1 |
| 5,558,147 A | * | 9/1996 | Zofziger | 160/190 |
| 5,655,591 A | | 8/1997 | Knutson | 160/265 |
| 5,730,197 A | | 3/1998 | Schwingle | 160/265 |
| 5,887,385 A | | 3/1999 | Hoerner et al. | 49/26 |

FOREIGN PATENT DOCUMENTS

| | | |
|---|---|---|
| FR | 0526352 | * 10/1989 |
| FR | 2653485 | * 10/1989 |

* cited by examiner

*Primary Examiner*—Daniel P. Stodola
(74) *Attorney, Agent, or Firm*—Marshall, Gerstein & Borun

(57) ABSTRACT

A counteraction system for a sectional door includes a counterweight system that helps counterbalance the weight of the door and helps hold the door in place when the door is fully open. The counterweight system comprises a suspended string of individual deadweights. As the door opens, the weights sequentially lower onto the floor, in a stacked arrangement, one atop the other. Thus, the hanging weight of the counterweight system decreases as the door opens. To avoid having the counterweight system slam the door open against a hard stop, the counteraction system also includes a brake system that helps bring the door to a smooth stop at the door's fully open position. In some embodiments, the brake system includes a cable that traverses the direction that the door travels. As the door approaches its open position, a protrusion on the door catches the cable, which deflects to decelerate the door.

12 Claims, 10 Drawing Sheets

COUNTERACTION SYSTEM FOR A SECTIONAL DOOR

BACKGROUND OF THE INVENTION

1. Field of the Invention

The subject invention generally pertains to sectional doors and more specifically to a counteraction system for such a door.

2. Description of Related Art

Sectional doors are commonly used as residential garage doors; however, they are also often used in warehouses and other industrial buildings. A sectional door typically includes a series of panels whose adjacent horizontal edges are connected by hinges. As the door opens or closes, the door panels travel along two lateral tracks. The tracks typically include a vertical section and an overhead section with a transitional curved section between the two. To close the door, the tracks guide the panels to a vertical position across the doorway. When the door opens, the hinges allow at least some of the panels to curve around onto the overhead section of the tracks. Such doors can be powered open and closed or moved manually.

To fit a sectional door underneath a standard 8-foot high ceiling of a typical residential garage, the vertical section of tracks is of limited height and the overhead section of tracks is generally horizontal. However, to take full advantage of generally higher ceilings in warehouses and other industrial buildings, a certain type of sectional door known as a "high-lift" may be used. With a high-lift sectional door, the vertical section of tracks is extended and the overhead section may lie at an incline, such as a 15-degree incline from horizontal. The inclined overhead section and the extra vertical section provides greater clearance for material handling equipment, parts, and other equipment that may need to pass underneath the overhead tracks. With high-lift doors, one or more panels may store in the vertical and/or curved section of tracks when the door is at its fully open position.

To ease the operation of a sectional door, a torsion spring is often used to counteract the weight of the door panels. The spring strain increases as the door closes to compensate for the added weight of each additional door panel as the panels move off the horizontal tracks and into the vertical ones. Typically, the preload of the torsion spring is adjusted to be sufficient to hold the door fully open, yet not be so great that the spring prevents the door from ever staying closed under the door's own weight. Sometimes it can be difficult to provide a torsion spring with just the right amount of preload.

A door's torsion spring can be improperly adjusted during the initial installation of the door, or the spring's preload can diminish as the spring ages. An inadequately preloaded spring may allow a sectional door to droop into the doorway or prevent the door from fully opening. An open door that is drooping can place its lowest door panel at an elevation where the panel is susceptible to being struck by vehicles, such large trucks, trailers, and forklifts. As a vehicle passes through the doorway, an upper edge of the vehicle may catch the lower edge of the door, and thus break or damage the door.

If the torsion spring were replaced by a simple counterweight to counter the door's weight, the constant deadweight force exerted by the counterweight would not take into account the changing downward force of the door, as the door moves between its vertical and overhead positions. If the counterweight were of a weight that was just enough to hold the door open, such a counterweight would be insufficient to counter the total weight of the door panels when the door is closed. Thus, the weight of the door would make it difficult to open. Conversely, if the counterweight were of a weight that allowed the door to set gently down to its closed position (i.e., the counterweight being about equal to the accumulative weight of the door panels), that same weight may be excessive when the door approaches its open position, as much of the door's weight is then supported by the overhead tracks. Such an excessive counterweight increases the force required to start pulling the door back down to its closed position.

Also, an excessive counterweight may slam the door against a hard stop at the door's open position. To reduce that problem, conventional shock absorbers could be used to absorb the impact of the door hitting the stop. Such devices, however, are typically of an inline design with very limited travel for the amount of deceleration that the door may require.

SUMMARY OF THE INVENTION

In order to counter at least some of the weight of a sectional door, the door is provided with a counteraction system that includes a series of counterweights that apply a greater force on the door when the door is closed than when the door is open.

In some embodiments, the counterweight force applied to the door remains substantially constant when the door is near its fully closed position.

In some embodiments, the counterweight force applied to the door remains substantially constant when the door is near its fully open position.

In some embodiments, the counterweights are sequentially shed as the door opens.

In some embodiments, the counterweights are suspended from each other.

In some embodiments, the counterweights slide vertically within a tube.

In some embodiments, a rotatable drum couples the plurality of counterweights to the door.

In some embodiments, at least one counterweight helps hold the door in place when the door is at its fully open position.

In some embodiments, the counteraction system includes a brake system comprising a pliable member extending along a direction that traverses a direction that the door moves.

In some embodiments, the counterweight that helps hold the door open also exerts a force that deflects the brake system's pliable member.

DESCRIPTION OF THE PREFERRED EMBODIMENT

Figure 1A:
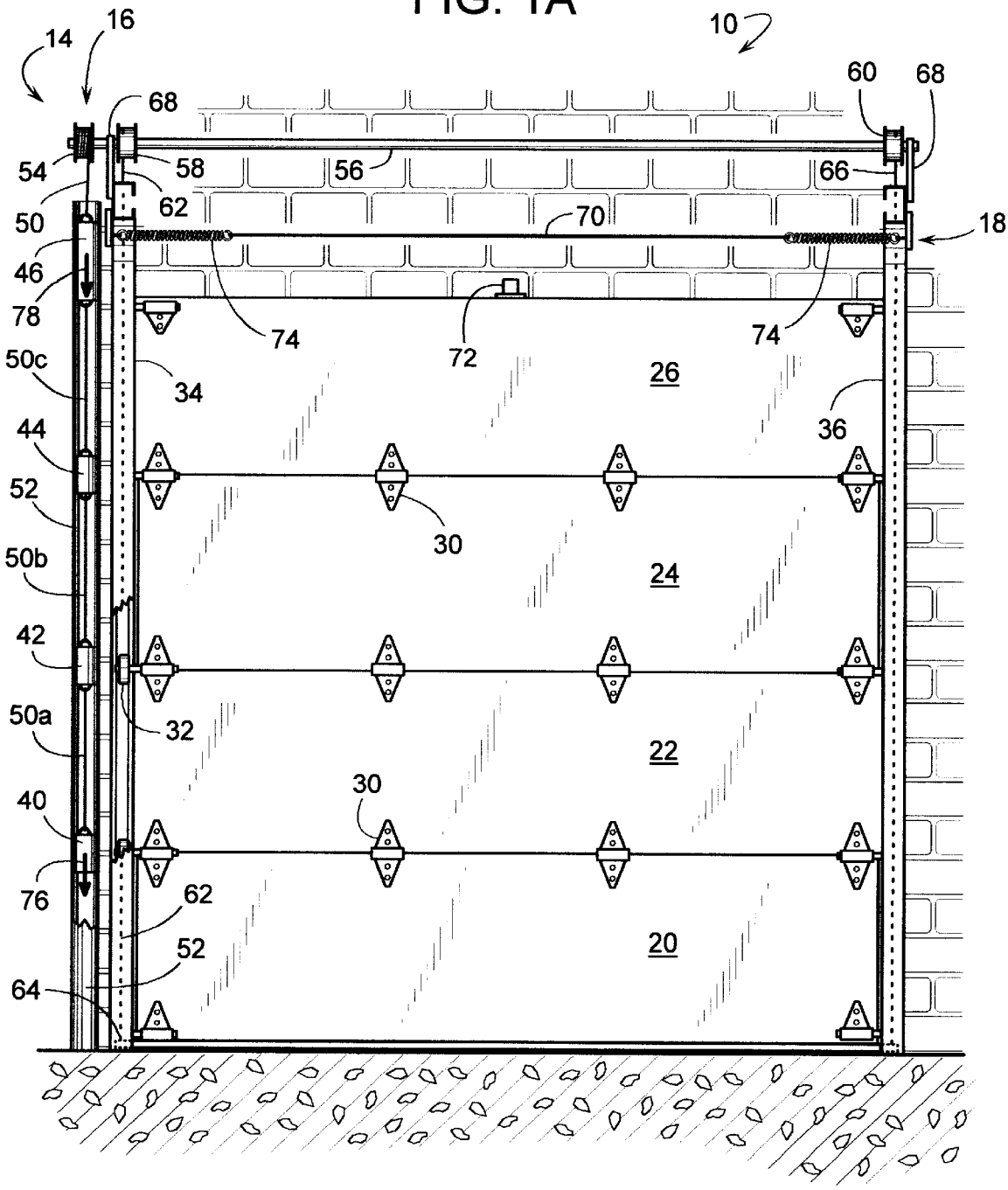
FIG. 1A is a view of a fully closed sectional door, as viewed from inside a building, wherein the door is provided with one embodiment of a counteraction system.
Figure 1B:
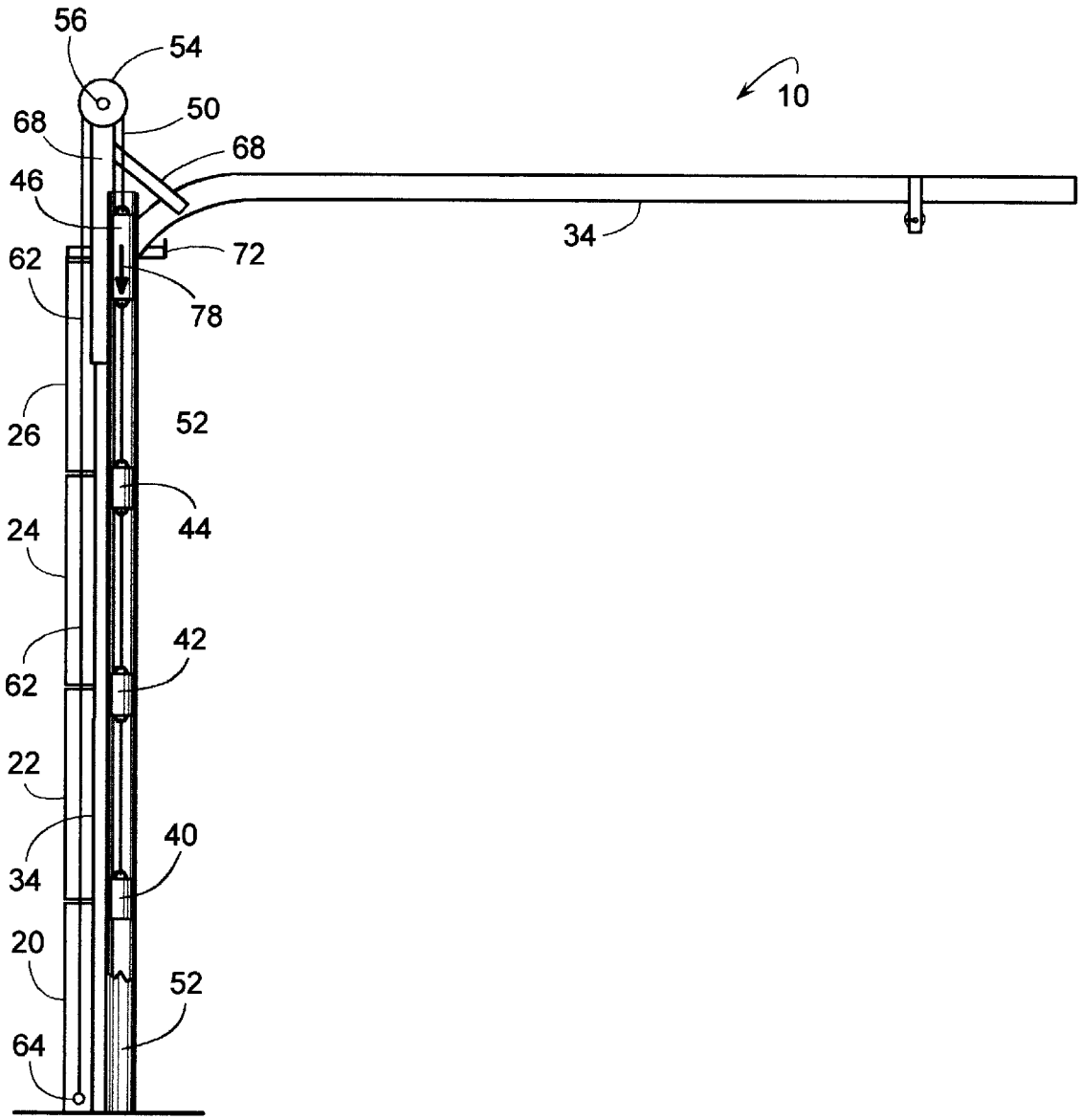
FIG. 1B is a side view of FIG. 1A.
Figure 2A:
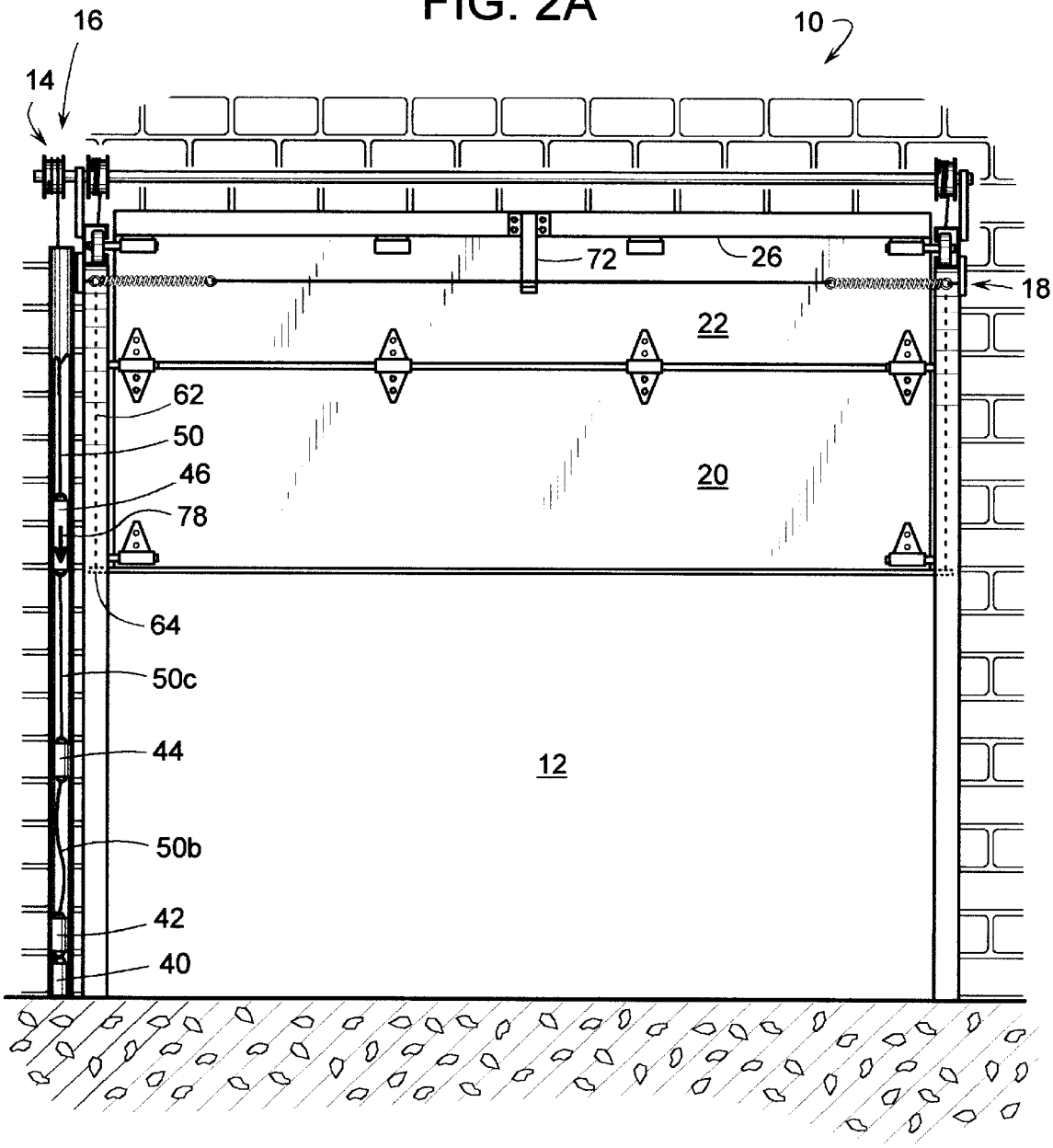
FIG. 2A is similar to FIG. 1A, but with the door at an intermediate position.
Figure 2B:
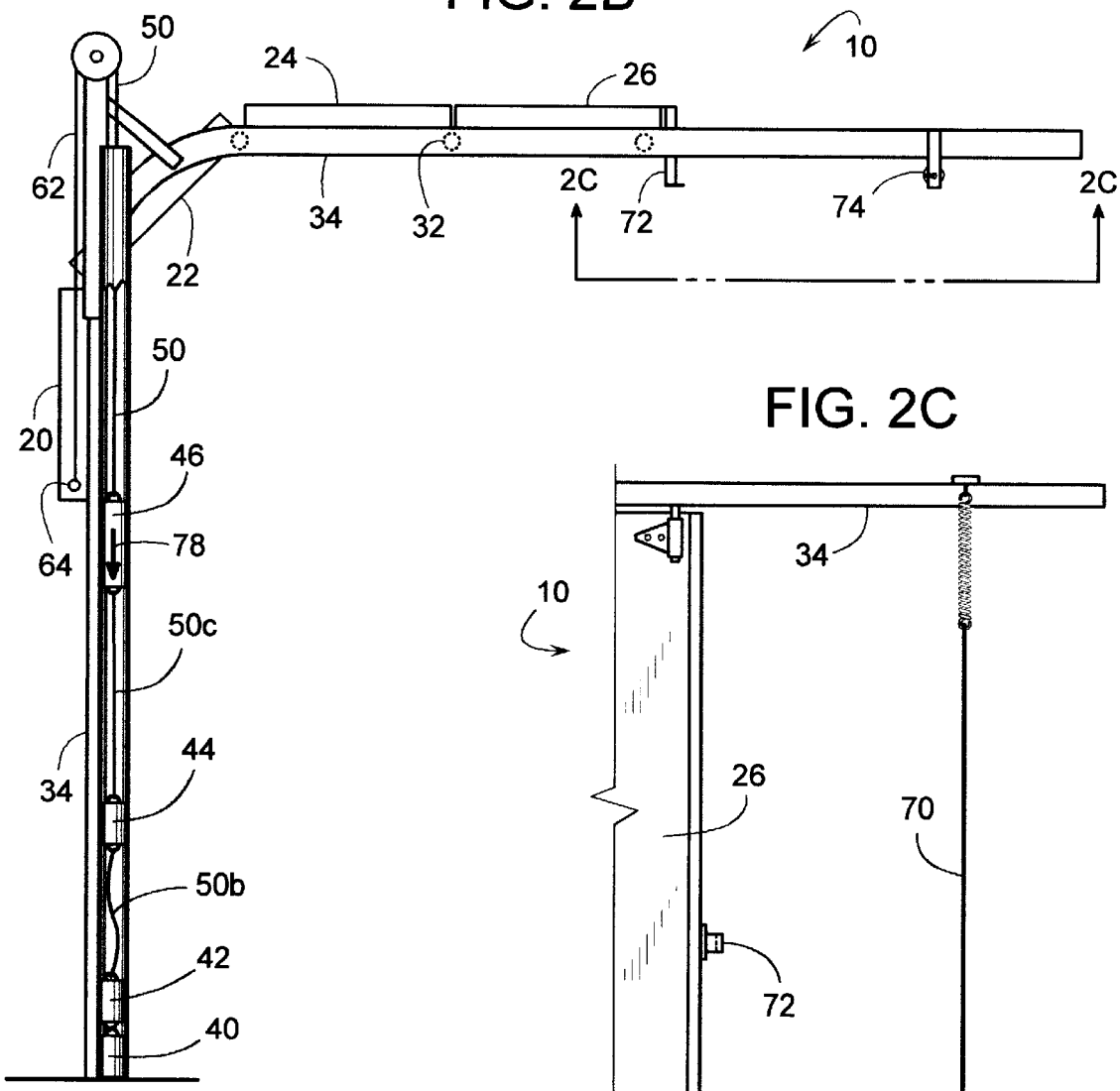
FIG. 2B is a side view of FIG. 2A
Figure 2C:
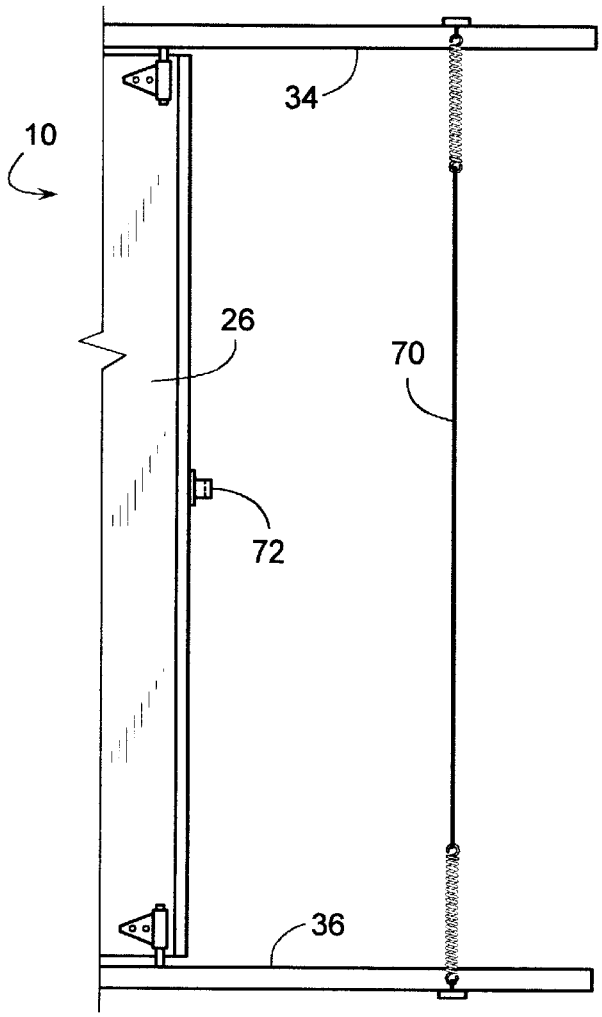
FIG. 2C is a bottom view taken along line 2C—2C of FIG. 2B.
Figure 3A:
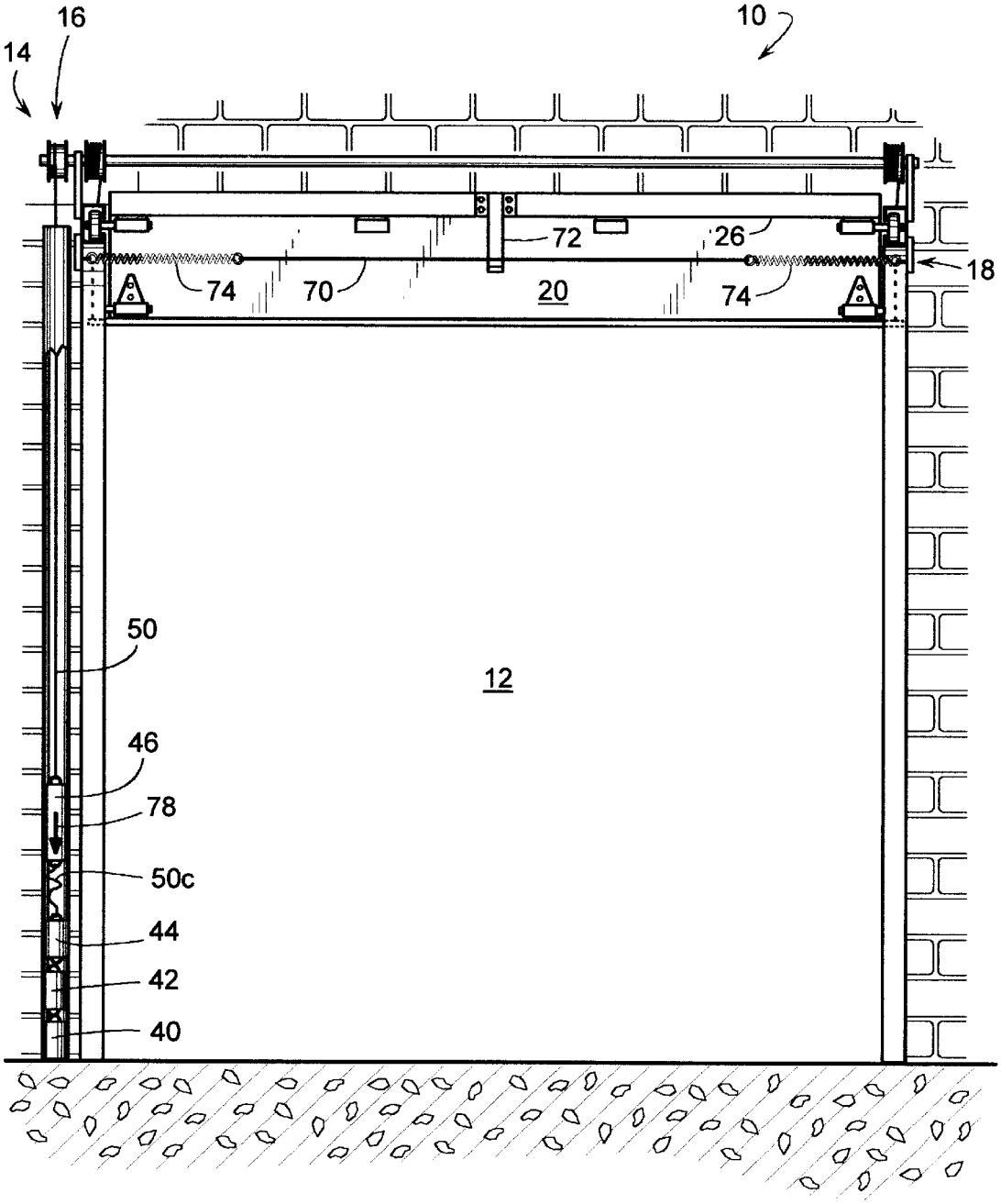
FIG. 3A is similar to FIG. 1A, but with the door at a fully open position.
Figure 3B:
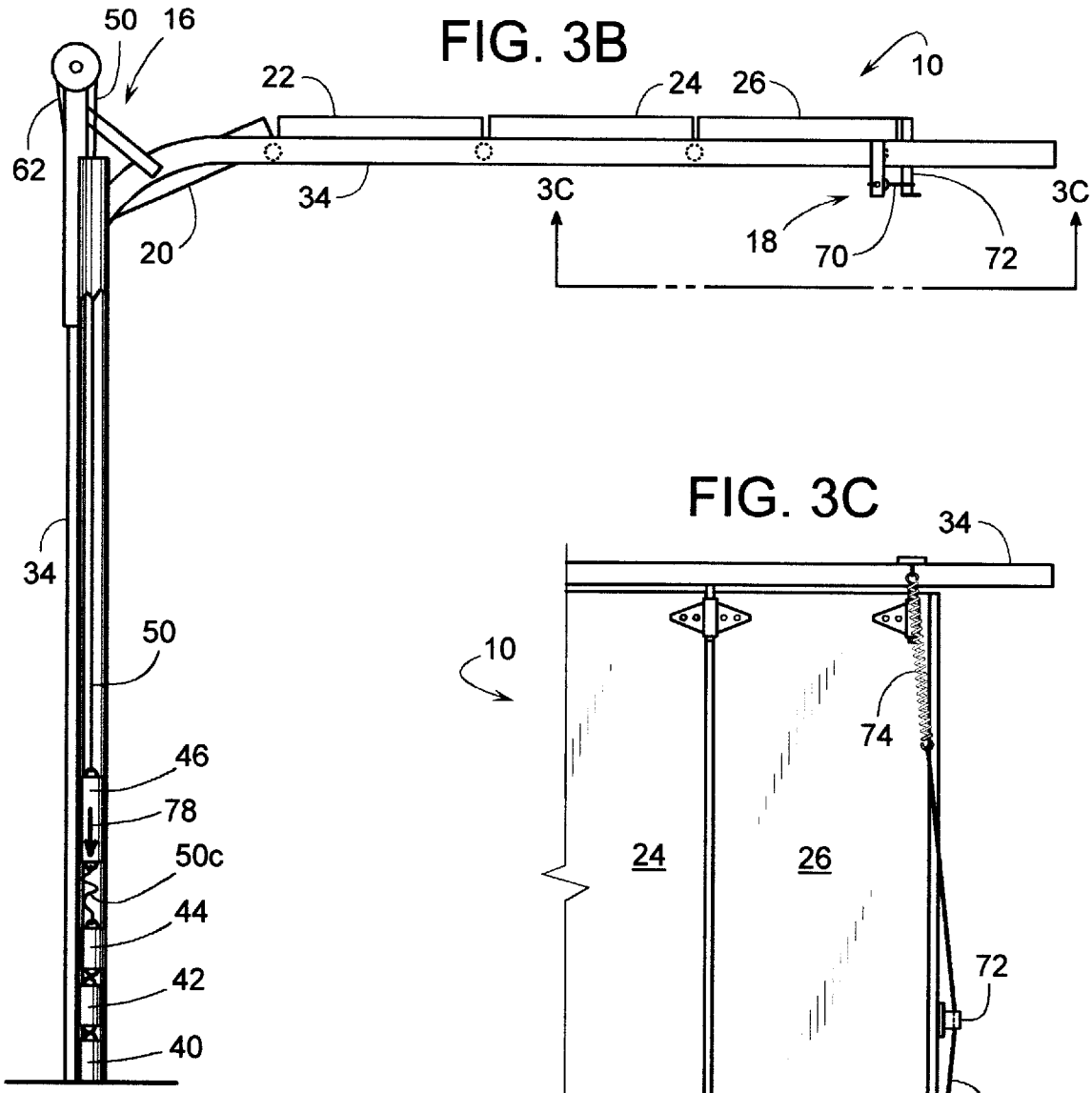
FIG. 3B is a side view of FIG. 3A
Figure 3C:
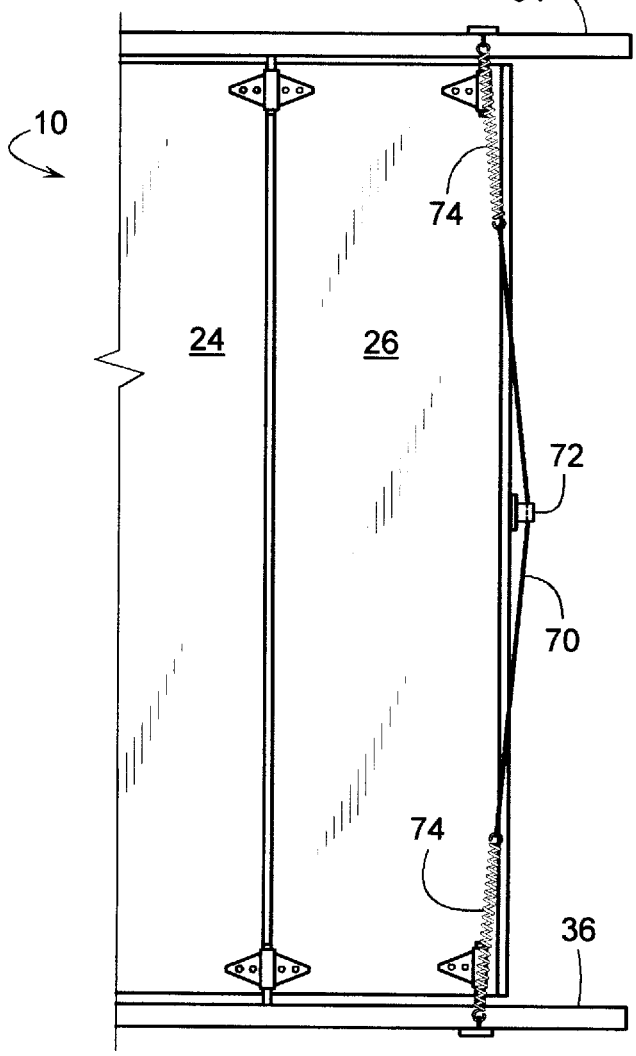
FIG. 3C is a bottom view taken along line 3C—3C of FIG. 3B.

A sectional door 10 is shown closed in FIGS. 1A and 1B, fully open in FIGS. 3A–C, and shown at one intermediate position in FIGS. 2A–C. To help counter the weight and momentum of door 10 as the door opens and closes across a doorway 12, door 10 is provided with a counteraction system 14. Counteraction system 14 includes a counterweight system 16 that helps counterbalance the weight of the door and helps hold the door fully open. Counteraction system 14 may also optionally include a brake system 18 that helps bring door 10 to a smooth stop at the door's open position.

Door 10 includes a series of door panels 20, 22, 24 and 26 that are interconnected along their adjacent horizontal edges by hinges 30. As door 10 opens or closes, guide members, such as rollers 32, guide the movement of the panels along two lateral tracks 34 and 36. In this example, tracks 34 and 36 curve between horizontal and vertical. To close door 10, the vertical sections of tracks 34 and 36 guide the panels to a vertical position across doorway 12. When door 10 opens, hinges 30 allow the panels to curve around onto the horizontal sections of tracks 34 and 36, where the door panels store horizontally overhead. Door 10 can be power operated or open and closed manually.

If it were not for counterweight system 16 or some other type of counterweight system, the upward force would not only be excessive, but the force required to open door 10 would vary significantly due to the door's weight shifting as the door panels move from the vertical to overhead section of tracks 34 and 36. The force would decrease as more panels become supported by the overhead section of the tracks. Thus, without a counterweight system, the difficulty to open door 10 would be based on the maximum lifting force, which would occur when door 10 was closed.

To reduce the maximum required lifting force, counterweight system 16 counters the weight of the door panels to a varying degree, depending on the position of the door. When door 10 is closed, counterweight system 16 applies the greatest upward force to door 10. However, to allow the weight of the door panels to help hold door 10 at its closed position, counterweight system 16 provides an upward force that is less than or equal to the total weight of the door panels. As door 10 moves toward its open position, the upward force applied by counterweight system 16 decreases according to the number of panels that move onto the horizontal section of the tracks. At some point, the upward force provided by counterweight system 16 preferably exceeds the downward force of the door panels. That is, the upward force exceeds the total weight of the door panels minus the amount of that weight which is supported by the horizontal section of the tracks. Thus, in some embodiments, counterweight system 16 renders door 10 bi-stable, wherein the weight of the door panels exceeds the counterweight force to hold door 10 down when door 10 is closed, and the force provided by counterweight system 16 exceeds the doors otherwise unsupported weight when door 10 is open.

To achieve such operation, counterweight system 16 includes a suspended string of counterweights 40, 42, 44 and 46 whose weights are sequentially set upon a stop or some other type of resting place (e.g., on the floor in a stacked arrangement, one atop the other) to incrementally decrease the suspended weight as door 10 opens. The term, "counterweight" refers to deadweight as opposed to spring-loaded devices. The counterweights are preferably set down sequentially, with one weight being shed with every door panel that travels into the curved section of tracks 34 and 36; however, the actual timing of when the weights are shed relative to the position of the panels can vary.

To sequentially shed the counterweights, the counterweights are interconnected by couplings that at times maintain a fixed length between adjacent counterweights, and at other times allow one counterweight to move relative to another. Such couplings can assume various forms; however, in a preferred embodiment, the couplings are in the form of a cable or some other pliable elongated member, such as, a strap, chain, rope, etc. In this embodiment, one cable segment 50*a* suspends counter weight 40 from weight 42, a second cable segment 50*b* suspends weight 42 from weight 44, and a third cable segment 50*c* suspends weight 44 from weight 46. To suspend the entire string of counterweights within a guide tube 52, one end of cable 50 connects to and wraps around a drum 54, and another end of cable 50 connects to weight 46.

To use the counterweights 40, 42, 44 and 46 to help counter the weight of the door panels, drum 54 is mounted to a rotatable shaft 56 to which two additional drums 58 and 60 are attached. Drums 54, 58 and 60 are each mounted to shaft 56, so that drums 54, 58 and 60 rotate with shaft 56. This can be readily accomplished using conventional wheel-to-shaft mounting methods, which include, but are not limited to, keys, splines, setscrews, locking collars, collets, etc. Another cable 62 has one end connected to door 10 (e.g., at a point 64 on panel 20), and has an opposite end attached to and wrapped around drum 58. Yet, another cable 66 connects to door 10 and drum 60 in a manner similar to that of cable 62. Shaft 56, in turn, is supported by a brace 68, which can be connected to tracks 34 and 36, and/or mounted to some other convenient structure, such as a wall or ceiling. Cables 62 and 66 wrap around their drums in a clockwise direction, while cable 50 wraps around its drum in a counterclockwise direction, or vice versa. So, as drums 58 and 60 draw in cables 62 and 66, drum 54 pays out cable 50. Thus, counterweights 40, 42, 44 and 46 move in a generally opposite direction as the lower edge of door panel 20 (e.g., the weights lower as the door opens, and vice versa).

In some embodiments, the weight of the door panels hanging from cables 62 and 66 applies a counterclockwise torque to shaft 56, and the tension in cable 50 (due to counterweights 40, 42, 44 and 46 hanging from cable 50) opposes that torque by applying a clockwise torque to shaft 56, with the rotational directions being with reference to the views of FIGS. 1B, 2B and 3B. When door 10 is near its closed position, the torque created by the door's own weight can be more than, less than, or equal to the torque created by the counterweights. If the total weight of the door's panels are greater than the total weight of the counterweights, then the torque differential on shaft 56 turns the shaft counterclockwise until door panel 20 rests on the floor, as shown in FIGS. 1A and B.

To open door 10, the door panels are lifted either manually or by way of a powered actuator. As door 10 opens, the upward movement of door panel 20 raises the lower ends of cables 62 and 66. This allows drums 58 and 60 to draw in more of cables 62 and 66 as counterweights 40, 42, 44 and 46 urge shaft 56 to rotate clockwise. As door panels 20, 22, 24 and 26 sequentially move onto the horizontal section of tracks 34 and 36, counterweight 40 is the first to be lowered onto the floor (or some other stop), which incrementally reduces the force and torque that the string of counterweights now apply to drum 58 via the tension in cable 50. As door 10 continues to open, counterweight 42 is set down upon weight 40, followed by weight 44 being set down upon weight 42. As the counterweights are set down, the cable segments 50*a*, 50*b* and 50*c* becomes limp and weights 40, 42 and 44 are no longer contributing to the tension in cable 50. Eventually, door 10 will be at or near it fully open position with only counterweight 46 remaining suspended from cable 50 and cable segment 50*c* being slack, as shown in FIGS. 3A and 3B. Counterweight 46 maintaining tension in cable 50 is what helps hold door panel 20 up once door 10 is fully open, as shown in FIGS. 3A and 3B. The relative movement between adjacent counterweights as provided by couplings 50*a*, 50*b* and 50*c* results in the tension in cable 50 varying as the respective weights are shed. Accordingly, these couplings can be thought of alternatively as either: 1) at times maintaining a fixed length between adjacent counterweights and at times allowing for relative movement between adjacent counterweights; or 2) at times allowing the counterweight suspended therefrom to contribute to the tension in cable 50 (by virtue of the coupling itself being in tension in this embodiment), and at times not allowing the associated counterweight to contribute to the tension in cable 50 (by virtue of not being in tension itself in this embodiment).

To prevent counterweight 46 from slamming the door panels against a hard stop at the door's open position, brake system 18 decelerates door 10 at a reasonable rate. To do this, brake system 18 includes a cable 70 (or some other elongated pliable member, such as a chain, strap, rope, wire, elastic cord, etc.) extending in a direction traversing a traveling direction of one of the door panels. A protrusion 72 or some other moving portion of door 10 is disposed at a position to catch cable 70 as door 10 approaches its open position. In some embodiments, protrusion 72 attaches to upper door panel 26, and two tension springs 74 (or some other compliant member) connect opposite ends of cable 70 to tracks 34 and 36 (or some other convenient mounting structure). As protrusion 72 engages cable 70, springs 74 allow cable 70 to deflect, which provides a travel distance over which the door decelerates. The normal and deflected positions of cable 70 are shown in FIGS. 2C and 3C, respectively. FIGS. 3B and 3C show a point of equilibrium where the force of counterweight 46 urging door 10 open opposes the restorative force that brake system 18 applies to urge door 10 closed.

In closing door 10, the motions and reactions of door 10 and counterweight system 16 is the reverse of that when opening door 10. That is, the counterweights are lifted sequentially as the door panels move back down into the vertical section of tracks 34 and 36. As stated earlier, when the door is near its closed position, the weight of the panels exceeds that of the counterweights, which helps hold the door shut.

It should be noted that counterweight 40 applies a first force 76 to cable segment 50*a*, wherein force 76 is greater when the door is closed than when the door is open. Moreover, force 76 is substantially constant as the door moves from its closed position to some intermediate open position where door panel 20 is lifted off the floor, but counterweight 40 has not yet been set down upon the floor or some other stop. Also, when door 10 is fully open, cable segment 50*a* is limp and force 76 is substantially zero. Further, counterweight 46 applies a second force 78 that is substantially constant as door 10 moves between its open and closed positions.

Figure 4A:
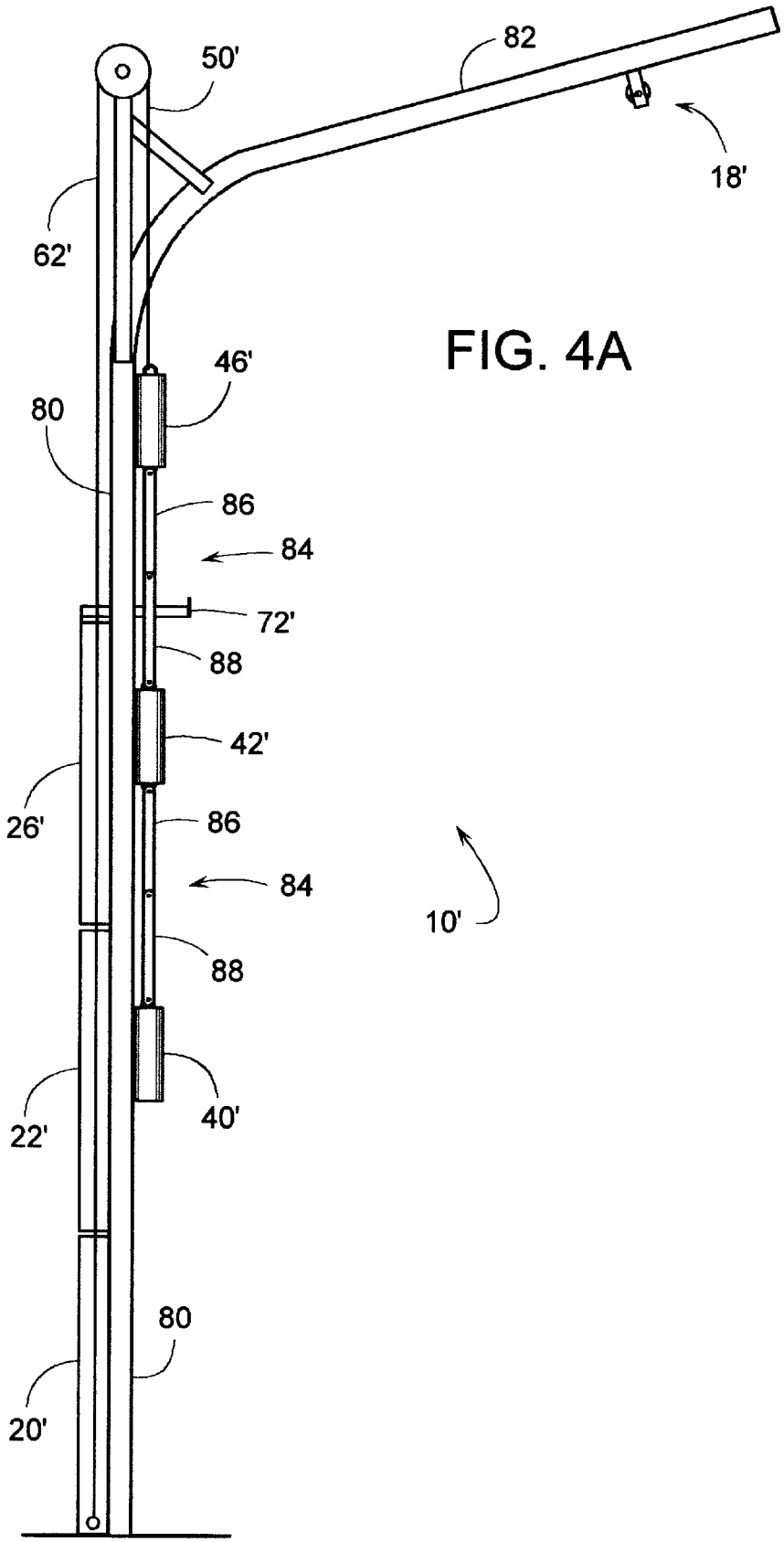
FIG. 4A is similar to FIG. 1B, but illustrating another embodiment of a sectional door with a counteraction system.
Figure 4B:
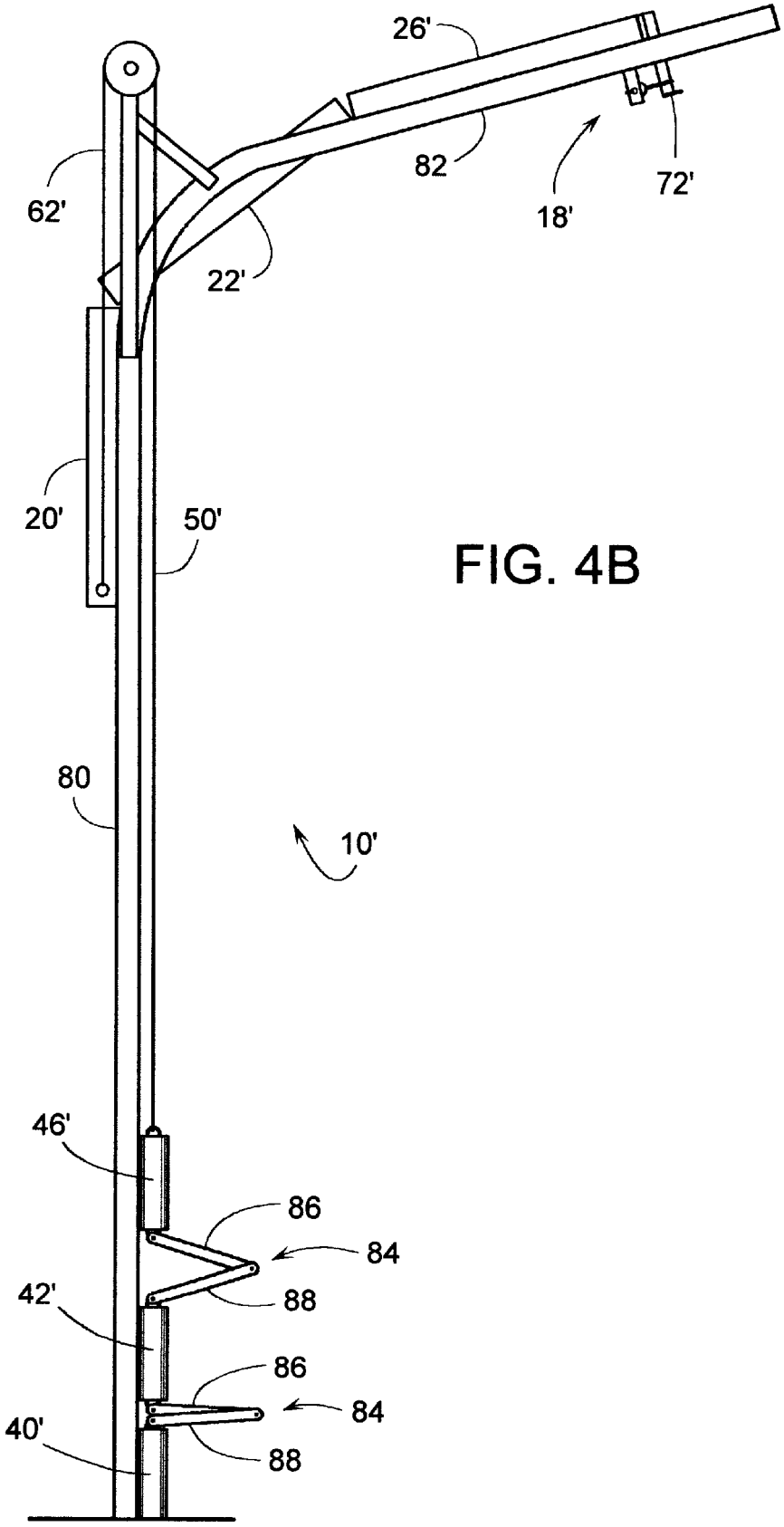
FIG. 4B is the door of FIG. 4A, but with the door fully open.

In an embodiment similar to door 10 and counteraction system 14, a high-lift door 10' is provided with a counteraction system 14', as is shown in FIGS. 4A with door 10' closed and shown in FIG. 4B with door 10' open. Doors 10 and 10' are similar, but they do have a few differences. Door 10' has an extra long section of vertical track 80 and an inclined overhead section of track 82. Instead of four panels and four counterweights, door 10' has three panels 20', 22' and 26' suspended from a cable 62' and three counterweights 40', 42' and 46' suspended from a cable 50'. To sequentially shed the counterweights, the counterweights are each interconnected by a coupling 84 that at times maintains a fixed length between adjacent counterweights (FIG. 4A) and thus allows the suspended counterweight to contribute to the tension in 50', and at other times allows one counterweight to move relative to another (FIG. 4B) to prevent the associated counterweight from contributing to the tension in 50'. To do this, each coupling 84 includes two pinned linkages 86 and 88 that are held in tension when their adjacent counterweights are moving together, as shown in FIG. 4A. Linkages 86 and 88 are free to collapse when one or more counterweights are set down upon the floor, as shown in FIG. 4B, or set down upon some other stop. Door 10' is provided with a protrusion 72' and brake system 18' that are similar in structure and function as protrusion 72 and brake system 18.

Figure 5A:
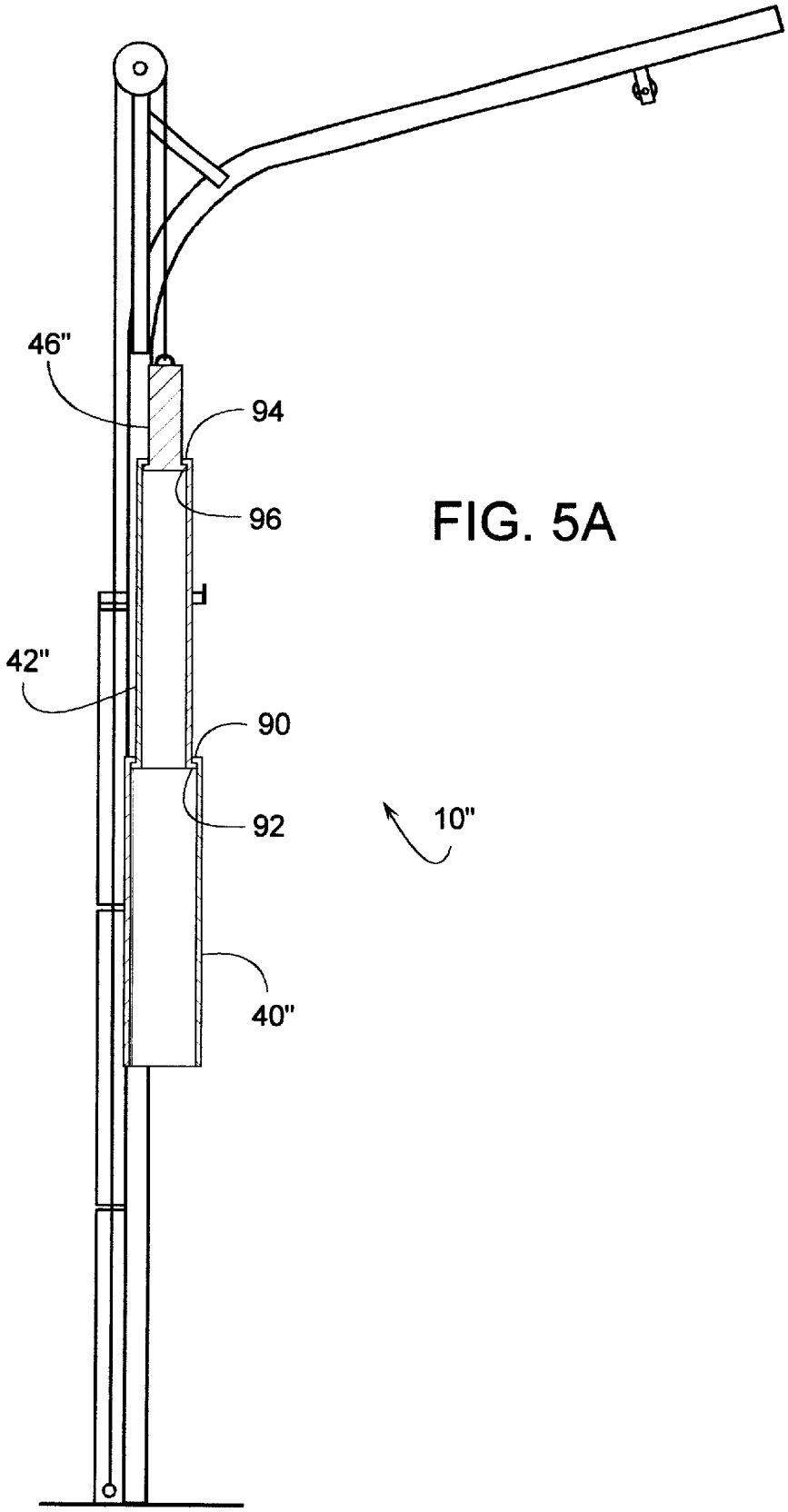
FIG. 5A is similar to FIG. 1B, but illustrating yet another embodiment of a sectional door with a counteraction system.
Figure 5B:
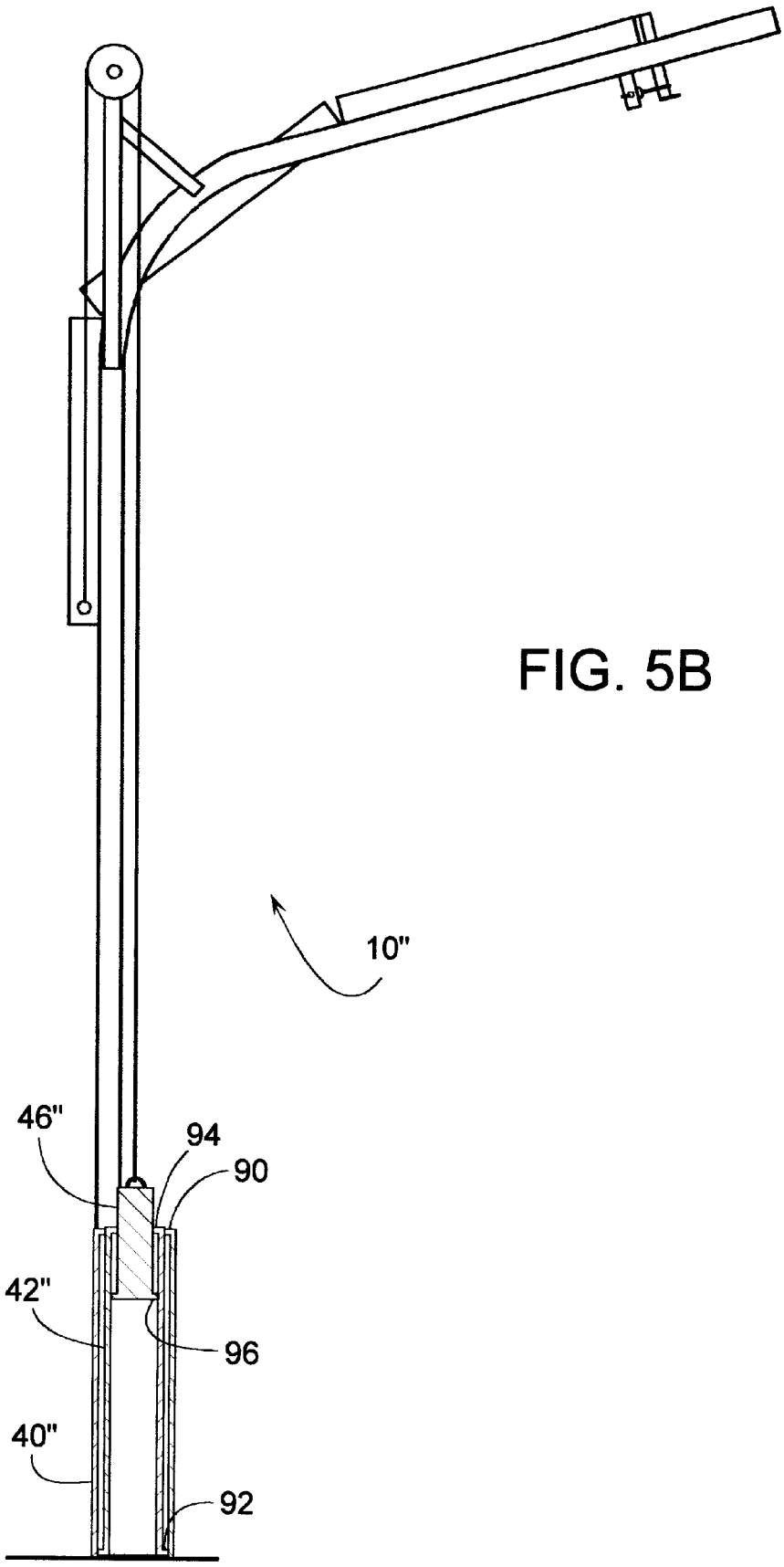
FIG. 5B is the door of FIG. 5A, but with the door fully open.

Another high-lift door 10", shown closed in FIGS. 5A and open in FIG. 5B, is similar to door 10', except for the counterweight system. Door 10" includes telescoping counterweights 40", 42" and 46", wherein interlocking edges 90/92 and 94/96 serve as couplings that at times maintain a fixed length between adjacent counterweights (FIG. 5A) such that the lower counterweight contributes to the tension in the cable from which the counterweight system is suspended (i.e., cable 50' in the embodiment of FIG. 4) and at other times allows one counterweight to move relative to another (FIG. 5B) such that the lower counterweight does not contribute to the tension in the cable.

Although the invention is described with reference to a preferred embodiment, it should be appreciated by those skilled in the art that various modifications are well within the scope of the invention. For example, the illustrated design and mounting configurations of protrusion 72 and cable 70 reflect a currently preferred embodiment, and numerous other designs and mounting configurations should be apparent to those skilled in the art. The quantity of counterweights can be other than three or four, and the quantity does not have to match the quantity of door panels. The vertical spacing and weight can also vary from one counterweight to another. In some cases, the cable that suspends the counterweights may be lengthened or shortened to adapt to overhead tracks of various inclines. Therefore, the scope of the invention is to be determined by reference to the claims that follow.

I claim:

1. A counteraction system and a door that is moveable to an open position, a closed position and an intermediate position therebetween, the counteraction system comprising:

a first counterweight adapted to exert a first force that helps counter the weight of the door, wherein the first force is greater when the door is in the closed position than when the door is in the open position; and a protrusion attachable to the door such that the protrusion can travel with the door along a first direction as the door approaches the open position, and a pliable member extending along a second direction traversing the first direction, wherein the protrusion when attached to the door engages the pliable member as the door approaches the open position and separates from the pliable member as the door closes.

2. The counteraction system and door of claim 1, wherein the pliable member is held in tension.

3. The counteraction system and door of claim 1, wherein the pliable member includes a cable.

4. The counteraction system and door of claim 3, wherein the pliable member includes a spring coupled to the cable.

5. A counteraction system and a door that is moveable between an open position and a closed position, the counteraction system comprising:

a protrusion attachable to the door such that the protrusion can travel with the door along a first direction as the door approaches the open position; and a pliable member running along a second direction traversing the first direction, wherein the protrusion when attached to the door engages the pliable member as the door approaches the open position and separates from the pliable member as the door closes.

6. The counteraction system and door of claim 5, herein the pliable member is held in tension.

7. The counteraction system and door of claim 5, wherein the liable member includes a cable.

8. The counteraction system and door of claim 7, wherein the pliable member includes a spring coupled to the cable.

9. The counteraction system and door of claim 5, further comprising a first counterweight adapted to exert a first force that helps counter the weight of the door.

10. The counteraction system and door of claim 9, wherein the first force causes the pliable member to deflect when the door is at the open position.

11. The counteraction system and door of claim 9, wherein the first force is sufficient to prevent the pliable member from closing the door.

12. A counteraction system and a door that is moveable between an open position an a closed position, the counteraction system comprising:

a protrusion attachable to the door such that the protrusion can travel with the door along a first direction as the door approaches the open position;

a pliable member running along a second direction traversing the first direction, wherein the protrusion when attached to the door engages the pliable member as the door approaches the open position and separates from the pliable member as the door closes; and a first counterweight adapted to exert a first force that helps counter the weight of the door, wherein the first force causes the pliable member to deflect when the door is at the open position.

* * * * *

UNITED STATES PATENT AND TRADEMARK OFFICE

CERTIFICATE OF CORRECTION

PATENT NO. : 6,560,927 B2
DATED : May 13, 2003
INVENTOR(S) : Schulte

It is certified that error appears in the above-identified patent and that said Letters Patent is hereby corrected as shown below:

Column 7,
Line 31, please delete “herein” and insert -- wherein --.

Column 8,
Line 2, please delete “liable” and insert -- pliable --.
Line 16, please delete “an a closed position” and insert -- and a closed position --.

Signed and Sealed this

Twentieth Day of January, 2004

JON W. DUDAS
*Acting Director of the United States Patent and Trademark Office*